US006048676A

United States Patent [19]

De Leener et al.

[11] Patent Number: 6,048,676

[45] Date of Patent: Apr. 11, 2000

[54] LIGHT-TIGHT PACKAGE FOR A ROLL OF LIGHT-SENSITIVE MATERIAL

[75] Inventors: Antoine De Leener, Westerlo; Wim Hauchecorne, Puurs; Dirk Peeters, Kontich; Danny Van Geyte, Schilde, all of Belgium

[73] Assignee: Agfa-Gevaert, Mortsel, Belgium

[21] Appl. No.: 09/201,979

[22] Filed: Dec. 1, 1998

Related U.S. Application Data

[60] Provisional application No. 60/072,759, Jan. 27, 1998.

[30] Foreign Application Priority Data

Dec. 4, 1997 [EP] European Pat. Off. ..... 97203813

[51] Int. Cl.[7] ..... G03C 3/00; B65D 85/672

[52] U.S. Cl. ..... 430/501; 206/410; 206/416; 206/316.1; 242/348.4

[58] Field of Search ..... 430/501; 206/410, 206/416, 316.1; 242/348.4

[56] References Cited

U.S. PATENT DOCUMENTS

| | | | |
|---|---|---|---|
| 4,148,395 | 4/1979 | Syracuse et al. | 206/414 |
| 4,505,387 | 3/1985 | Seto | 206/414 |
| 5,738,210 | 4/1998 | Kausch et al. | 206/416 |

FOREIGN PATENT DOCUMENTS

| | | | |
|---|---|---|---|
| 0828185 | 11/1979 | European Pat. Off. | G03C 3/00 |
| 0743556 | 5/1981 | European Pat. Off. | G03C 3/00 |
| 0632322 | 7/1983 | European Pat. Off. | G03C 3/00 |
| 0350093 | 4/1984 | European Pat. Off. | G03C 3/00 |
| 0779541 | 3/1986 | European Pat. Off. | G03C 3/00 |
| 0786695 | 6/1987 | European Pat. Off. | G03C 3/00 |
| 9704358 | 8/1978 | WIPO | G03C 3/00 |

*Primary Examiner*—Mark F. Huff
*Attorney, Agent, or Firm*—Baker Botts L.L.P.

[57] ABSTRACT

An improved light-tight package for a roll of light-sensitive strip material. The package includes a substantially straight, light-tight end cover for each end surface of the roll, and a light-tight flexible circumferential cover secured to the end covers and to the coiled strip material and covering the outermost convolution thereof. Each end cover includes a flexible disc and a rigid disc. The flexible discs are positioned between the end surfaces of the roll and the rigid discs.

9 Claims, 2 Drawing Sheets

LIGHT-TIGHT PACKAGE FOR A ROLL OF LIGHT-SENSITIVE MATERIAL

This application claims the benefit of U.S. Provisional Application No. 60/072,759 filed Jan. 27, 1998.

FIELD OF THE INVENTION

The present invention relates to a light-tightly packaged roll of light-sensitive strip material wound on a supporting core.

More specifically the invention is related to a roll which is intended for daylight loading of a dispenser cassette which, after its loading, can be placed in a suitable cooperating apparatus, generally an exposure apparatus, such as an imagesetter or a COM (computer output on microfilm) system.

BACKGROUND OF THE INVENTION

Light-tightly packaged rolls are known, wherein a roll of light-sensitive strip material, e.g. photographic film or paper, a polyester printing plate, or another light-sensitive strip material, is wound on a hollow supporting core. Such packaged rolls comprise a light-tight flexible end cover for each end surface of the roll, each end cover having a central opening and being light-tightly attached to a corresponding end of the core, and a light-tight flexible circumferential cover secured to the coiled strip material and covering the outermost convolution of the roll. The peripheral areas of the end covers and the side ends of the circumferential cover are light-tightly fitted to each other so as to obtain a light-tight and/or moisture-tight wrapping.

The flexibility of the end covers causes several problems. In the first place, when dispensing the light-sensitive material, the covers may press against the unwinding light-sensitive material, which results in varying friction forces between the end covers and the light-sensitive material. Because of varying friction, the light-sensitive material is not transported smoothly, but with shocks, through the exposure apparatus. When an image is exposed on the light-sensitive material during transport, image quality suffers from the unsmoothness of transport. This problem will hereinafter be referred to as the "unsmooth transport" problem.

In the second place, the flexible end covers may bend inwards to the core. Thus, when the dispensed light-sensitive material is rewound back onto the roll, the flexible end covers may be caught between the windings of the roll, which may result in damage to the light-sensitive material. Rewinding the light-sensitive material will hereinafter be called "reverse winding".

Patent application EP-A-0 786 695 discloses a light-tight package for a roll, wherein each end cover consists of an opaque flexible disc, on the outside of which a thin polymer layer of e.g. 30 to 50 $\mu$m is extruded. After the extrusion, the polymer layer cools down and shrinks, inducing stresses into the flexible disc, as a result of which the flexible disc is bent to the outside, i.e. towards the extruded polymer layer and away from the roll. The flexible discs are welded to the circumferential cover and to the core.

While this package may solve the problems concerning unsmooth transport and reverse winding, mentioned hereinbefore, it presents several drawbacks. In the first place, it is difficult to control the cooling and the shrinkage process after the extrusion. As a consequence, the magnitude of the induced stresses and of the deformation of the flexible discs may vary widely. This has an adverse effect on the reliability of reverse winding and of smooth transport during unwinding. In the second place, an extra layer, of a heat-resistant lacquer, is required on the extruded polymer layer to prevent the polymer layer from melting when the flexible discs are welded to the circumferential cover and to the core.

Patent application EP-A-0 779 541 solves these drawbacks to a certain extent. It discloses a light-tight package for a roll, wherein each end cover consists of an opaque tearable flexible disc and a rigid disc, the rigid disc being positioned between the flexible disc and the end surface of the roll. The rigid discs have an outer diameter less than or equal to the outer diameter of the roll, while the flexible discs have a larger outer diameter. The outer portions of the flexible discs are folded over the rigid discs and are secured to the circumferential cover of the roll by means of adhesive tape. The adhesive tape and the flexible covers are tearable, and the circumferential cover includes a portion adapted to initiate a tear in the tape and the flexible discs.

However, this package also presents several drawbacks. A first drawback is the presence of tearable adhesive tape, and thus, the risk of contamination with adhesives of the light-sensitive strip material or of the dispensing apparatus. Another drawback is the fact that the flexible discs must be folded over the circumferential cover, which requires an extra step in the packaging process. Further, to initiate a tear in the tape and the flexible discs, the circumferential cover must have a complicated shape; several shapes are illustrated in the patent application.

OBJECTS OF THE INVENTION

It is an object of the present invention to provide a light-tight package for a roll of the type referred to, from which the strip material, after its loading into a cooperating apparatus, can be dispensed without shocks.

It is a further object of the invention to provide reliable reverse winding of a dispensed or partly dispensed roll in a cooperating apparatus.

It is another object of the invention to provide a package with limited dimensions, so that the package easily fits into a wide range of existing dispenser cassettes and cooperating apparatuses.

It is yet another object of the invention to provide a solution to the above mentioned drawbacks.

SUMMARY OF THE INVENTION

The above mentioned objects are realised by a light-tight package having the specific features defined in claim 1. Specific features for preferred embodiments of the invention are set out in the dependent claims.

Further advantages and embodiments of the present invention will become apparent from the following description.

A "substantially straight" end cover stands for an end cover having side surfaces that lie substantially in a flat plane, i.e. the maximum distance between a side surface and the corresponding flat plane is smaller than 2 mm, preferably smaller than 1 mm, still more preferably smaller than 0.5 mm. More accurately defined: a disc-like end cover is delimited by four—usually circular—curves. The first and the second curve are inner curves, delimiting the central opening of the end cover, where the end cover is attached to the core. The third and the fourth curve are outer curves, forming the peripheral contour of the end cover. The first and the third curve delimit the proximal side surface of the end cover, while the second and the fourth curve delimit the distal side surface; the end cover itself lies between the proximal and the distal side surfaces. The proximal side surface is the surface nearest to the axis of the roll, and the distal side surface is the surface furthest from the axis of the roll. The proximal flat plane is defined as the flat plane through the—inner—first curve; the distal flat plane is the flat plane through the—inner—second curve. The maximum perpendicular distance of any point of the proximal side surface to the proximal flat plane should be smaller than 2 mm, preferably smaller than 1 mm, still more preferably smaller than 0.5 mm. The same condition applies to any point of the distal side surface with respect to the distal flat plane. An end cover may have folded margins, either inner margins that can e.g. be tucked within the ends of the core, or outer margins that can e.g. be sealed to the circumferential cover; such an end cover is substantially straight if the end cover, excluding the margins, is substantially straight.

The "buckling value" of an end cover stands for a value that is representative for the resistance to buckling of the end cover, a larger buckling value corresponding to a higher resistance to buckling. The buckling value depends on the geometry of the end cover and on the material(s) the end cover is made of. A more extensive definition of the "buckling value" is given hereinafter.

BRIEF DESCRIPTION OF THE DRAWINGS

The invention is described hereinafter by way of example with reference to the accompanying figures, wherein.

DETAILED DESCRIPTION OF THE INVENTION

Figure 1:
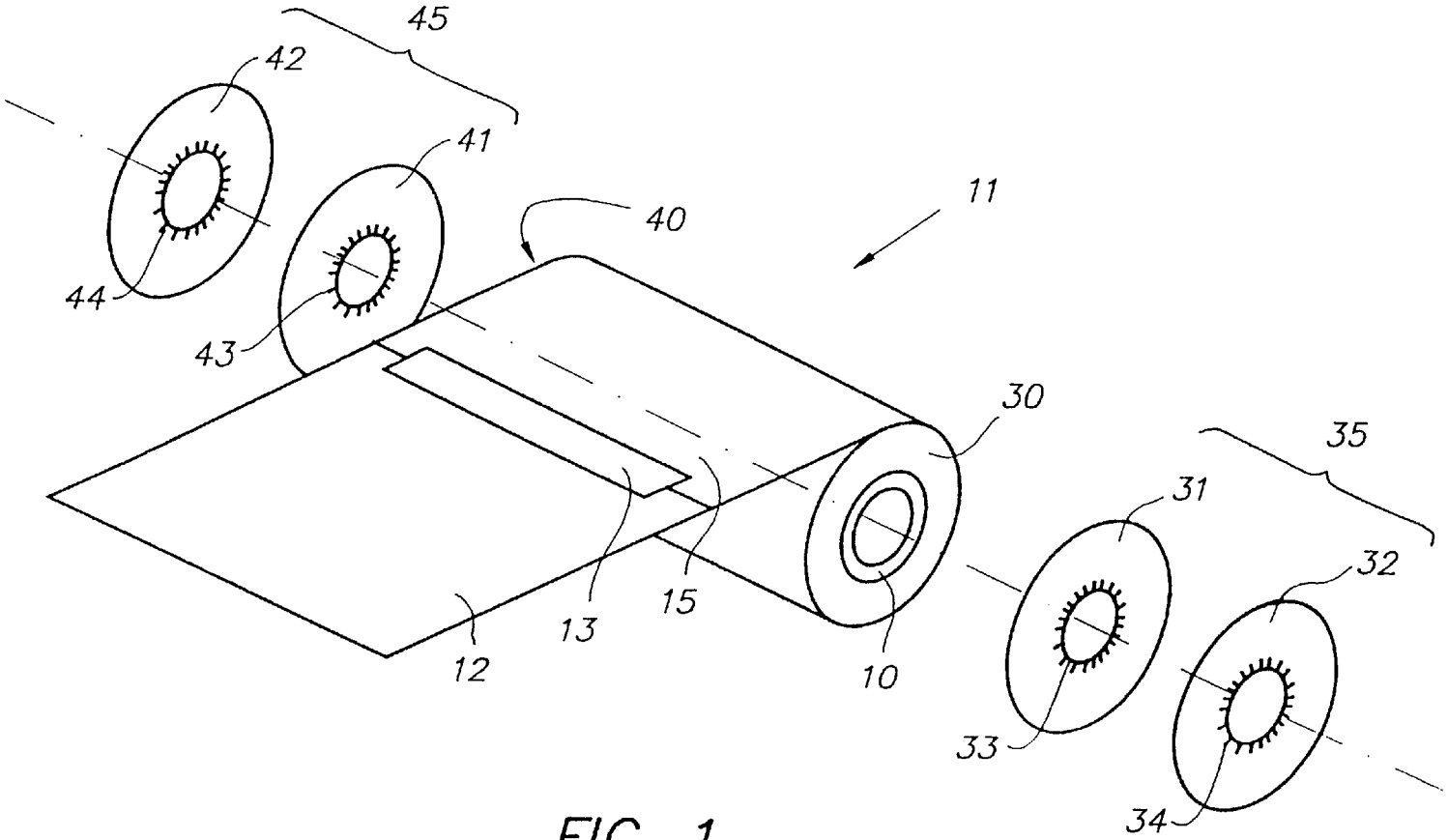
FIG. 1 shows an exploded view of an embodiment of a package in accordance with the present invention.

FIG. 1 shows an exploded view of an embodiment of a light-tight package wherein a roll 11 of light-sensitive strip material 15 is wound on a, preferably hollow, supporting core 10. A light-tight flexible circumferential cover 12 is secured to the coiled strip material 15, e.g. by means of a strip of non-tearable adhesive tape 13. Two light-tight end covers 35 and 45 are light-tightly attached to the corresponding ends of the core. Each end cover 35 resp. 45 comprises a flexible disc 31 resp. 41 and a rigid disc 32 resp. 42. The flexible disc 31 is positioned between the end surface 30 of the roll and the rigid disc 32; the flexible disc 41 is positioned between the end surface 40 of the roll and the rigid disc 42. In a preferred embodiment, the flexible discs 31, 41 have margins 33, 43 at their inner diameter, that are tucked within the ends of the core and sealed thereto. In another preferred embodiment, the flexible discs 31, 41 and the rigid discs 32, 42 all have margins at their inner diameter, the margins 33 coinciding with margins 34, and margins 43 coinciding with 44; the coinciding margins are tucked within the ends of the core and sealed thereto.

The circumferential cover 12 has a width in excess of the wound strip material. To shield the roll of strip material from light, the circumferential cover is wound around the coiled strip material, so that it covers the outermost convolution thereof, and is light-tightly attached to the end covers. As disclosed in patent application EP-A-0 739 916, the package may have a leader, not shown in FIG. 1, that may be attached to the circumferential cover or that may be part of the circumferential cover, and by means of which the strip material can be threaded in the slot of a dispenser cassette. Preferably, the leader is an extension of slightly reduced width of the circumferential cover, an extension that is not secured to the end covers. Preferably, the leader has a tapered shape.

Figure 2:
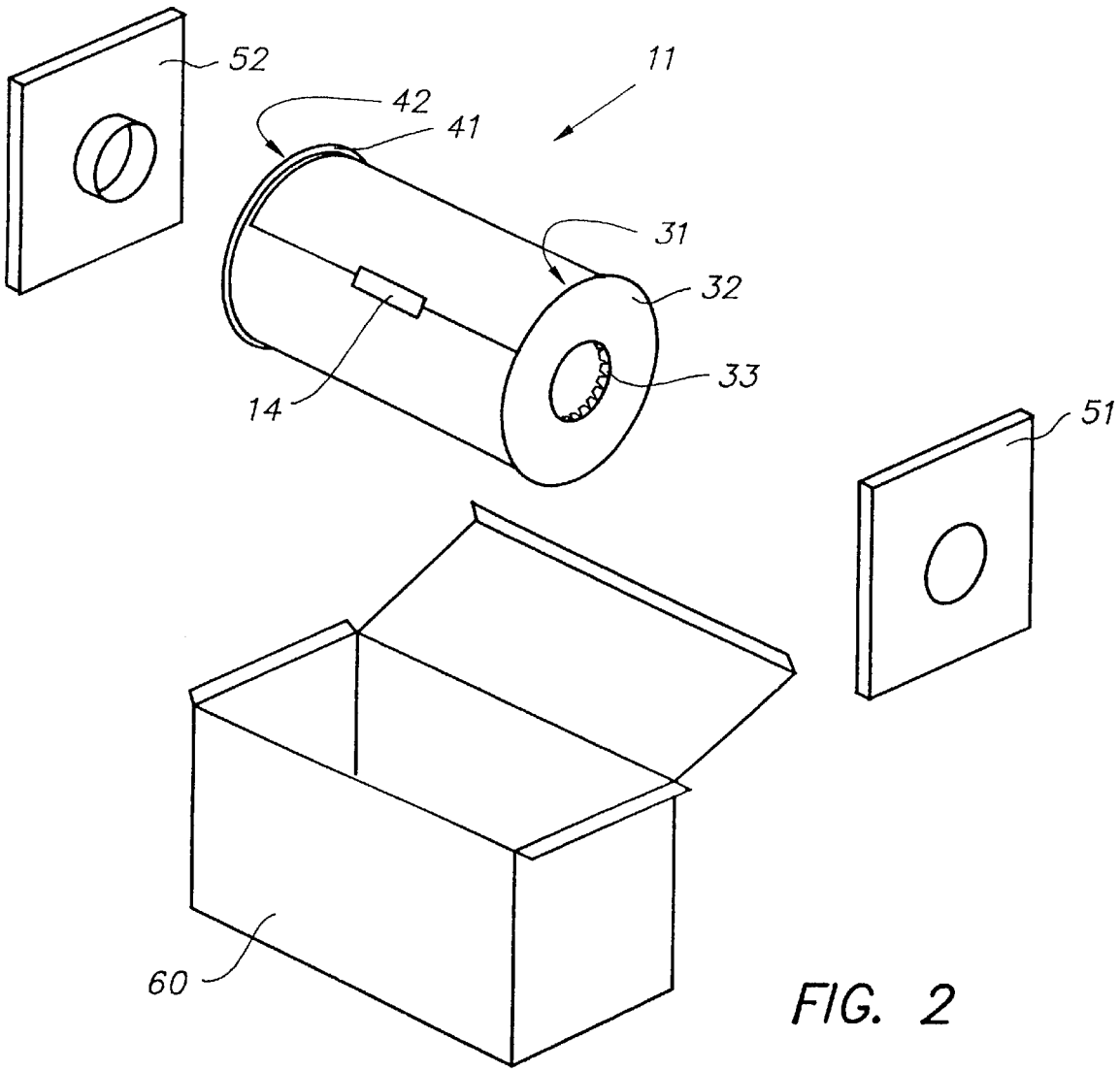
FIG. 2 shows an embodiment of a package in accordance with the present invention, ready to be packed into a cardboard box.

FIG. 2 shows a roll package as described. Two rigid flanges 51, 52, having a hub engaging the corresponding core opening, support the roll when it is packed into a rectangular cardboard box 60 for storage and shipping. Instead of flanges, other supporting means known in the art may be used, such as shells having an inner hemicylindrical surface that supports the outer roll surface, without supporting the end covers. Optionally, the roll package can be wrapped into a dustproof foil before packing it into the box.

As disclosed hereinbefore, each end cover comprises a flexible disc 31, 41 and a rigid disc 32, 42. In a preferred embodiment, the flexible discs 31, 41 are light-tightly sealed to the circumferential cover 12. The rigid discs 32, 42 are added to increase the buckling value of the end discs.

We found that the problems with reverse winding, where an end cover is caught between the windings of the roll, are due to a buckling effect. The end covers are slender, i.e. their thickness is small with respect to their diameter. Moreover, they are made of materials having a small modulus of elasticity. Therefore, if a too large compressive force is exerted upon an end cover, it will not fail because its yield strength is exceeded, but it will buckle, i.e. deflect to the side, and hence it may be caught between the windings of the rewound light-sensitive strip material.

The compressive force mentioned above can be caused by the strip material touching an end cover. Normally, the strip material is rewound centred with respect to the end covers of the roll, so that there is a small spacing at the left hand side, between the left side of the strip and the left end cover, and analogously a small spacing at the right hand side. The strip material may however deviate to the left or to the right from this central position during reverse winding, e.g. due to changes in the torque of the motor driving the roll, due to small alignment errors of the rollers leading the strip through the cooperating apparatus, etc. Due to such a deviation, the strip material may touch an end cover and exert a compressive force on it, in the direction of the core of the roll.

The magnitude of the compressive force depends on the characteristics of the cooperating apparatus. The effect of the force depends on the geometry and the material properties of the end covers, and also on the geometry and the material properties of the strip material.

Information on buckling can be found in books on the theory of strength of materials and the like (e.g. in "Standard Handbook for Mechanical Engineers" by Baumeister et al, McGraw-Hill, eighth edition, chapter 5 "Strength of Materials", p. 5–40 ff). A slender steel column will fail by buckling when a critical load is reached. The critical load F can be calculated from Euler's formula:

$$F=k*E*I/L^2$$

wherein E is the modulus of elasticity of the column material (in Pa), I is the moment of inertia of the cross section of the column (in $m^4$), L is the length of the column (in m) and k is a constant. For a rectangular cross section, $I=b*h^3/12$, wherein b is the width (in m) and h the height (in m) of the cross section (the width b is the dimension parallel to the neutral line of the cross section).

For a disc-like geometry, we found that Euler's formula reduces to:

$$F=k'*C*s^3/Ø$$

$$=k'*B$$

with:

$$B=C*s^3/Ø$$

wherein C is a material constant (in Pa), s is the thickness of the disc (in m), Ø its diameter (in m), and k' is a constant. B is the buckling value (in Pa). For plastics and metals, $C=E_{compression}$, the compressional modulus of elasticity of the disc material. Values for $E_{compression}$ can be found e.g. in books on materials science. With respect to buckling, we found that for paper C=0.3 kN/mm$^2$. If the disc also has an inner diameter, its influence on the buckling value B is negligible if the inner diameter is 70% or less of the outer diameter. The diameter Ø in the formula for B is then taken equal to the outer diameter of the disc. As an example, for an end cover having an outer diameter of 100 mm and an inner diameter of 70 mm, Ø=100 mm=0.1 m. For a disc having an inner diameter larger than 70% of the outer diameter, the buckling value is determined by experiments, as described in the examples hereinafter.

In a preferred embodiment, the end covers are substantially straight. As mentioned hereinbefore, in the discussion of the drawbacks of patent application EP-A-0 786 695, it may be difficult to control the deformation of bent end covers, which may have an adverse effect on the reliability of reverse winding and of smooth transport during unwinding.

The end covers should be rigid enough to resist without buckling to compressive forces that can be caused as mentioned hereinbefore by the strip material touching an end cover, the magnitude of these compressive forces depending upon the characteristics of the cooperating apparatus. In a preferred embodiment, the buckling value of an end cover B>0.05 N, preferably B>0.1 N, still more preferably B>0.25 N. When B is smaller, transport may be unsmooth and reverse winding may be unreliable in currently available cooperating apparatuses, for currently available strip materials.

The rigidity of the discs 31, 41 resp. 32, 42 can be defined by means of their buckling value: according to the current invention, the buckling value $B_2$ of the rigid discs 32, 42 is larger than the buckling value $B_1$ of the flexible discs 31, 41.

Some calculations of buckling values of discs are given in the examples hereinafter.

In the manufacturing process of the packaged roll, the end covers are secured to the core and to the circumferential cover as follows, in a preferred embodiment. The end covers 35, 45 shown in FIG. 1 comprise flexible discs 31, 41 comprising a moisture-tight and light-tight heat-sealable foil, that may comprise layers of paper (e.g. 70 g/m$^2$), aluminium (thickness e.g. 9 $\mu$m), black pigmented heat-sealable polyethylene (thickness e.g. 38 $\mu$m). The core 10 preferably comprises cardboard, but it may also be made e.g. of plastic. The flexible discs 31, 41 have inner margins 33, 43 that are tucked within the ends of the core 10 and heat-sealed thereto, as disclosed in patent application EP-A-0 350 093. Then, the circumferential cover 12, which may be of the same basic material as the flexible discs, is fed towards the roll, and while the roll is slowly rotated, the rims of the circumferential cover are progressively brought into contact with the peripheral areas of the flexible discs, whilst applying heat and pressure. During the first convolution of the circumferential cover, the polyethylene innerside of the rims of the circumferential cover is sealed to the corresponding polyethylene innerside of the flexible discs. As one convolution is completed, the polyethylene innerside of the rims of the circumferential cover becomes sealed to the outerside of the already sealed rims of this cover. The sealed part of the circumferential cover preferably extends 360 to 720 angular degrees about the roll. The leader, not shown in FIG. 1, extends freely from the finished package. For shipping, the leader may be secured to the underlying circumferential cover, e.g. by a strip of adhesive tape 14 (FIG. 2). The overlapping of the circumferential cover over an angle between preferably 90 and 180 angular degrees ensures a reliable light-tight seal of the packaged roll.

Although heat-sealing is preferred, the end covers can also be secured to the circumferential cover and to the core in other ways, such as by glueing, by interposition of a two-sided adhesive ribbon or the like, etc.

It is preferred that the circumferential cover and the end covers each comprise a thermoplastic layer, e.g. a polyethylene layer, so that by heat-sealing these layers, the circumferential cover and the end covers can be secured to each other. The flexible discs most preferably comprise the materials mentioned above, but they may also comprise other materials, such as a laminate of polyethylene terephtalate with vacuum deposited aluminium and black polyethylene, polypropylene, and the like.

In another embodiment, the flexible discs 31, 41 have no margins 33, 43. Instead, the core 10 is provided at both its extremities with plastic rings (not shown), that are heat-sealed to the area of the inner diameter of the flexible discs.

In a preferred embodiment, the rigid discs 32, 42 comprise a laminate of polyethylene terephtalate (thickness e.g. 100 $\mu$m) and polyethylene (thickness e.g. 75 $\mu$m). In another embodiment, the rigid discs may comprise other materials, such as polycarbonate, polypropylene, polystyrene, acetate and the like.

Preferably, each rigid disc 32 resp. 42 is laminated to the corresponding flexible disc 31 resp. 41. In another embodiment, the corresponding rigid and flexible discs are co-extruded. The corresponding rigid and flexible discs may also be secured to each other in another way, such as by adhesives.

In a preferred embodiment, the rigid discs are present in the package as it is shipped to the customer, but the rigid discs can also be added later on, e.g. by the customer, to a package comprising only flexible discs and no rigid discs. In case the rigid discs are added later, self-adhesive rigid discs are preferred.

In a preferred embodiment, the outer diameter of the flexible discs is larger than the diameter of the roll; the difference between both diameters may e.g. be 5 to 15 mm, but it may also be larger, e.g. approximately 30 mm. An advantage is that deviations of the roll diameter can be coped with; in practice, the diameter of the roll of wound strip material may undergo deviations as high as 2 mm for a roll with a nominal diameter of 113 mm. These deviations are caused by small deviations in the thickness of the strip material, which are multiplied by the large number of convolutions of the roll. In another embodiment, the outer diameter of the end covers is equal to or is smaller than the diameter of the roll.

Preferably, the flexible discs and the rigid discs have substantially equal outer diameters, i.e. the difference between their diameters is smaller than 2 mm, preferably smaller than 0.5 mm, more preferably smaller than 0.2 mm. However, the outer diameter of the rigid discs may also be larger or may be smaller than the outer diameter of the flexible discs.

In a preferred embodiment, the inner diameter of the flexible discs is smaller than the inner diameter of the rigid discs, so that the flexible disc may comprise margins, that can easily, by means of automated equipment, be tucked into the ends of the core and sealed thereto. In another embodiment, the inner diameter of the flexible discs may be equal to or larger than the inner diameter of the rigid discs. The end covers may be sealed to the core in some other way than heat-sealing, as disclosed hereinbefore.

In another, even more preferred embodiment, the flexible discs and the rigid discs have substantially equal inner diameters, and have coinciding margins at their inner diameter. These margins can be tucked into the ends of the core and sealed thereto, preferably by means of automated equipment.

Loading a roll package according to the present invention in a cassette, loading this cassette into a cooperating apparatus and making it ready for use is not different from prior art roll packages, and is disclosed e.g. in patent application EP-A-0 230 057.

The embodiments disclosed hereinbefore are preferred embodiments, but the present invention is not limited to these embodiments.

Preferably, each end cover comprises two discs; an end cover may also comprise three or more discs.

Preferably, the core 10 is hollow, but it may e.g. also be solid having hollow ends, or completely solid.

In a preferred embodiment, the circumferential cover is secured to the flexible discs, but the circumferential cover may also be secured to other discs that are part of the end covers. The circumferential cover may also comprise end flange portions, as disclosed in patent application EP-A-0 350 093, that are folded and tucked within the ends of the core and sealed thereto.

Preferably, the leader is an extension of slightly reduced width of the circumferential cover, an extension that is not secured to the end covers. However, the leader may also be a separate strip, secured to the circumferential cover. In another embodiment, the leader is secured directly to the strip material, just as the circumferential cover is secured to the strip material. In this way, the leader and the circumferential cover overlap each other. The leader is covered by the circumferential cover, is longer than the circumferential cover and protrudes from the package. In yet another embodiment, the circumferential cover is secured to the strip material along a line L1 and the leader is secured to the circumferential cover along a line L2 that lies e.g. only a few mm away from line L1. Thus, the circumferential cover and the leader also overlap each other. The circumferential cover covers the leader. The leader is longer than the circumferential cover and protrudes form the package. In case the circumferential cover comprises end flange portions, as disclosed in patent application EP-A-0 350 093, the packaged roll leaves the leader exposed, and the packaging is tearable by pulling on the leader, as disclosed in the mentioned patent application.

A roll package may be loaded into a dispenser cassette that can be placed in a suitable cooperating apparatus, but the roll package may also be loaded directly into a cooperating apparatus.

The package according to the present invention provides important advantages.

Preferably, each end cover comprises a flexible disc and a rigid disc, wherein the flexible disc guarantees lighttightness of the package, and the rigid disc provides substantial straightness and a high buckling value, so that reliable reverse winding and smooth transport are ensured.

Many different materials may be used for manufacturing the flexible discs resp. the rigid discs. The flexible discs need not be made of a tearable material. The material of the rigid discs may be transparent, such as polyethylene terephtalate or a laminate thereof; this material is readily available in film imaging business.

In a preferred embodiment, the thickness of the end covers may be quite limited, e.g. 0.3 to 0.4 mm, while at the same time ensuring the advantages of adequate lighttightness and reliable reverse winding and smooth transport, advantages that can more easily be obtained by using thick, rigid end covers. However, it is important that the thickness of the end covers is limited because of dimensional considerations. In a dispenser cassette or cooperating apparatus, the packaged roll is placed on an unwinding spool. In current cassettes and cooperating apparatuses, there is virtually no space available in the axial direction between the roll package and the spool.

In the most preferred embodiment, no adhesives, no adhesive tape, and most preferably no tearable adhesive tape are required to secure the end covers to the circumferential cover and to the core, and to secure the discs constituting the end covers to each other. Thus, the risk of contamination with adhesives of the light-sensitive strip material or of the dispensing apparatus is eliminated.

In the preferred embodiments, the circumferential cover may have a quite simple shape; no complicated shape is required to initiate tearing. Preferably, the leader is an extension of slightly reduced width of the circumferential cover, and has a tapered shape.

In the preferred embodiments, because of the used materials and their thicknesses, no extra layer, of e.g. a heat-resistant lacquer, is required on the end covers to avoid melting problems when securing the end covers to the circumferential cover and to the core.

As is made clear from the description of the manufacturing process of the packaged roll, disclosed hereinbefore, and from the above mentioned advantages, a packaged roll according to the present invention is easy to produce, and the manufacturing process can easily be automated. The packaging process requires relatively few steps.

EXAMPLES

Since data illustrating the present invention, e.g. used materials and dimensions, are already mentioned hereinbefore, only some calculations of buckling values of discs are given below.

| Material | C [kN/mm$^2$] | s [mm] | Ø [mm] | B [N] |
|---|---|---|---|---|
| paper | 0.3 | 0.2 | 100 | 0.02 |
| HDPE | 2 | 0.12 | 100 | 0.03 |
| PET | 4 | 0.1 | 100 | 0.04 |
| PET | 4 | 0.2 | 100 | 0.32 |

In this table, the following acronyms are used:

PET: polyethylene terephtalate

HDPE: high density polyethylene

For a disc consisting of more than one material, the buckling value is determined by an experiment, in which the resistance to buckling of the disc is compared with the buckling resistance of discs consisting of a single material. Also, a lower limit resp. an upper limit of the buckling value can be calculated by assuming that the disc would completely consist of the weakest material (i.e. the material with the lowest C) resp. the strongest material. For example, a disc having a diameter of 100 mm and consisting of 0.1 mm paper and 0.1 mm PET has a buckling value between 0.02 and 0.32 N (these are the values for 0.2 mm paper resp. 0.2 mm PET, as shown in the table).

The experiment to determine the buckling value of a disc consisting of more than one material—called below the "unknown disc"—is as follows:

apply a force on the top of the unknown disc, acting towards the centre of the disc and in a plane perpendicular to the axis (shown as a dash-dot-dash line in FIG. 1) of the disc;

increase this force; the force $F_b$ at which buckling occurs is the buckling resistance of the unknown disc;

now apply a force equal to $F_b$ to a set of discs with a known buckling value. The discs of this set have the same diameter as the unknown disc, but different thicknesses, and they are made of one material. A set can e.g. consist of PET discs having thicknesses of 0.1 mm, 0.15 mm, 0.2 mm, etc. If buckling occurs for a disc $D_x$ of the set and not for the next disc $D_y$, the buckling value of the unknown disc lies between the buckling values of the discs $D_x$ and $D_y$. As an example, suppose buckling occurs at force $F_b$ for the PET disc of 0.15 mm and not for the PET disc of 0.2 mm, then the buckling value of the unknown disc lies between the buckling values of the PET discs of 0.15 mm and 0.2 mm.

To determine the buckling value of a disc D having a large inner diameter (i.e. larger than 70% of the outer diameter), an analogous experiment is done, using a set of discs having the same outer diameter as disc D, a small inner diameter (smaller than 50% of the outer diameter) and different thicknesses.

To determine whether a disc $D_1$ has a higher buckling value than a disc $D_2$, it suffices to determine for these discs the forces $F_{b1}$ and $F_{b2}$ at which buckling occurs: if $F_{b1}>F_{b2}$, then disc D1 has a higher buckling value.

Having described in detail preferred embodiments of the current invention, it will now be apparent to those skilled in the art that numerous modifications can be made therein without departing from the scope of the invention as defined in the appending claims.

| Parts list | |
|---|---|
| 10 | core |
| 11 | roll |
| 12 | circumferential cover |
| 13, 14 | tape |
| 15 | strip material |
| 30, 40 | end surface |
| 31, 41 | first disc |
| 32, 42 | second disc |
| 33, 34 | margin |
| 43, 44 | margin |
| 35, 45 | end cover |
| 51, 52 | flange |
| 60 | box |

We claim:

1. A light-tight package comprising in the package as shipped:

a supporting core;

a roll of light-sensitive strip material, coiled on the core, the roll having two opposite end surfaces;

a substantially straight, light-tight end cover for each end surface of the roll, each end cover:

being light-tightly attached to the corresponding end of the core;

having a buckling value B larger than 0.05 N; and each end cover comprising:

a first disc having a first buckling value $B_1$; and a second disc having a second buckling value $B_2$, larger than the first buckling value $B_1$;

each first disc being positioned between the corresponding end surface of the roll and the corresponding second disc, and a light-tight flexible circumferential cover secured to the coiled strip material and covering the outermost convolution thereof, the circumferential cover having a width in excess of the coiled strip material, and being light-tightly attached to the end covers.

2. The light-tight package according to claim 1, wherein each second disc is secured to the corresponding first disc.

3. The light-tight package according to claim 1, wherein the outer diameter of the first discs is larger than the diameter of the roll.

4. The light-tight package according to claim 1, wherein the circumferential cover is sealed to the first discs.

5. The light-tight package according to claim 1, wherein the outer diameter of the first discs is substantially equal to the outer diameter of the second discs.

6. The light-tight package according to claim 1, wherein the first discs are sealed to the core.

7. The light-tight package according to claim 1, wherein each first disc has margins at its inner diameter, that are tucked within the ends of the core and sealed thereto.

8. The light-tight package according to claim 1, wherein each first disc has margins at its inner diameter and each second disc has margins at its inner diameter, the margins of each second disc coinciding with the margins of each corresponding first disc, and the margins of each first disc and the margins of each second disc being tucked within the ends of the core and sealed thereto.

9. An assembly comprising:

a cardboard box;

a light-tight package according to claim 1;

two flanges for supporting the light-tight package.

* * * * *